US006767177B2

(12) United States Patent
Opitz

(10) Patent No.: US 6,767,177 B2
(45) Date of Patent: Jul. 27, 2004

(54) MAGNETIC LIFTING SYSTEM

(76) Inventor: Kary A. Opitz, 16744 10th St., Winthrop, MN (US) 55396

( * ) Notice: Subject to any disclaimer, the term of this patent is extended or adjusted under 35 U.S.C. 154(b) by 0 days.

(21) Appl. No.: 10/124,109

(22) Filed: Apr. 15, 2002

(65) Prior Publication Data

US 2003/0194305 A1 Oct. 16, 2003

(51) Int. Cl.[7] ..... B66C 1/00
(52) U.S. Cl. ..... 414/737; 414/920; 294/65.5
(58) Field of Search ..... 414/737, 920; 294/65.5; 335/291; 361/143, 144

(56) References Cited

U.S. PATENT DOCUMENTS

| | | | | | |
|---|---|---|---|---|---|
| 2,622,750 | A | | 12/1952 | Ehlers | 214/651 |
| 2,794,941 | A | * | 6/1957 | Anderson | 361/144 |
| 3,009,727 | A | | 11/1961 | Jones et al. | 294/65.5 |
| 4,323,329 | A | | 4/1982 | Chlad | 414/737 |
| 4,793,765 | A | * | 12/1988 | Paul et al. | 414/718 |
| 5,325,260 | A | * | 6/1994 | Repetto | 361/144 |
| 5,677,821 | A | * | 10/1997 | Myr | 361/143 |
| 5,731,705 | A | | 3/1998 | Guinn | 335/291 |
| 5,813,712 | A | * | 9/1998 | Mozelt | 294/65.5 |
| 5,977,730 | A | | 11/1999 | Clutter et al. | 318/141 |

* cited by examiner

*Primary Examiner*—Eileen D. Lillis
*Assistant Examiner*—Michael Lowe

(57) ABSTRACT

A magnetic lifting system for converting a skid loader into a magnetic lifting apparatus for transporting ferrous metals. The magnetic lifting system includes a platform attachable to a loader of a tractor, an arm member attached to the platform, and a magnet attached to the arm member by at least one chain. A generator upon the platform is mechanically connected to a hydraulic motor that is fluidly connected to the hydraulic system of the tractor to generate electricity. The generator is electrically connected to a controller which is electrically connected to a rheostat for controlling current flow to the magnet. The rheostat is electrically connected to the magnet by a power cable. The arm member is preferably slidably positioned within a receiver tube for allowing distal adjustment of the position of the magnet with respect to the platform.

18 Claims, 4 Drawing Sheets

MAGNETIC LIFTING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to magnetic lifting devices and more specifically it relates to a magnetic lifting system for converting a tractor into a magnetic lifting apparatus for transporting ferrous metals.

2. Description of the Related Art

Magnetic lifting machines have been in use for years. Conventional magnetic lifting machines are comprised of a crane structure with a generator connected to the motor of the magnetic lifting machine.

The main problem with conventional magnetic lifting machines is that they are bulky and difficult to utilize. Another problem with conventional magnetic lifting machines is that they are relatively expensive, particularly when they are not in constant usage by most users. Another problem with conventional magnetic lifting machines is that they are too large for smaller work areas.

Examples of patented devices which are related to the present invention include U.S. Pat. No. 4,323,329 to Chlad; U.S. Pat. No. 2,622,750 to Ehlers; U.S. Pat. No. 5,977,730 to Clutter et al.; U.S. Pat. No. 5,731,705 to Guinn; U.S. Pat. No. 4,002,937 to Anson; U.S. Pat. No. 3,009,727 to Jones et al.; U.S. Pat. No. 5,100,280 to George, Jr.; and U.S. Pat. No. 5,160,034 to Potter.

While these devices may be suitable for the particular purpose to which they address, they are not as suitable for converting a skid loader into a magnetic lifting apparatus for transporting ferrous metals. Conventional magnetic lifting devices are not feasible for usage upon smaller projects and are difficult to maneuver.

In these respects, the magnetic lifting system according to the present invention substantially departs from the conventional concepts and designs of the prior art, and in so doing provides an apparatus primarily developed for the purpose of converting a skid loader into a magnetic lifting apparatus for transporting ferrous metals.

BRIEF SUMMARY OF THE INVENTION

In view of the foregoing disadvantages inherent in the known types of magnetic lifting devices now present in the prior art, the present invention provides a new magnetic lifting system construction wherein the same can be utilized for converting a skid loader into a magnetic lifting apparatus for transporting ferrous metals.

The general purpose of the present invention, which will be described subsequently in greater detail, is to provide a new magnetic lifting system that has many of the advantages of the magnetic lifting devices mentioned heretofore and many novel features that result in a new magnetic lifting system which is not anticipated, rendered obvious, suggested, or even implied by any of the prior art magnetic lifting devices, either alone or in any combination thereof.

To attain this, the present invention generally comprises a platform attachable to a loader of a tractor, an arm member attached to the platform, and a magnet attached to the arm member by at least one chain. A generator upon the platform is mechanically connected to a hydraulic motor that is fluidly connected to the hydraulic system of the tractor to generate electricity. The generator is electrically connected to a controller which is electrically connected to a rheostat for controlling current flow to the magnet. The rheostat is electrically connected to the magnet by a power cable. The arm member is preferably slidably positioned within a receiver tube for allowing distal adjustment of the position of the magnet with respect to the platform.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a magnetic lifting system that will overcome the shortcomings of the prior art devices.

A second object is to provide a magnetic lifting system for converting a skid loader into a magnetic lifting apparatus for transporting ferrous metals.

Another object is to provide a magnetic lifting system that is cost effective.

An additional object is to provide a magnetic lifting system that may be utilized upon various types of tractors such as skid steer loaders.

A further object is to provide a magnetic lifting system that may be effectively utilized upon small to medium sized metal scrap operations.

Another object is to provide a magnetic lifting system that is easily attached and removed from a tractor.

A further object is to provide a magnetic lifting system that is versatile.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
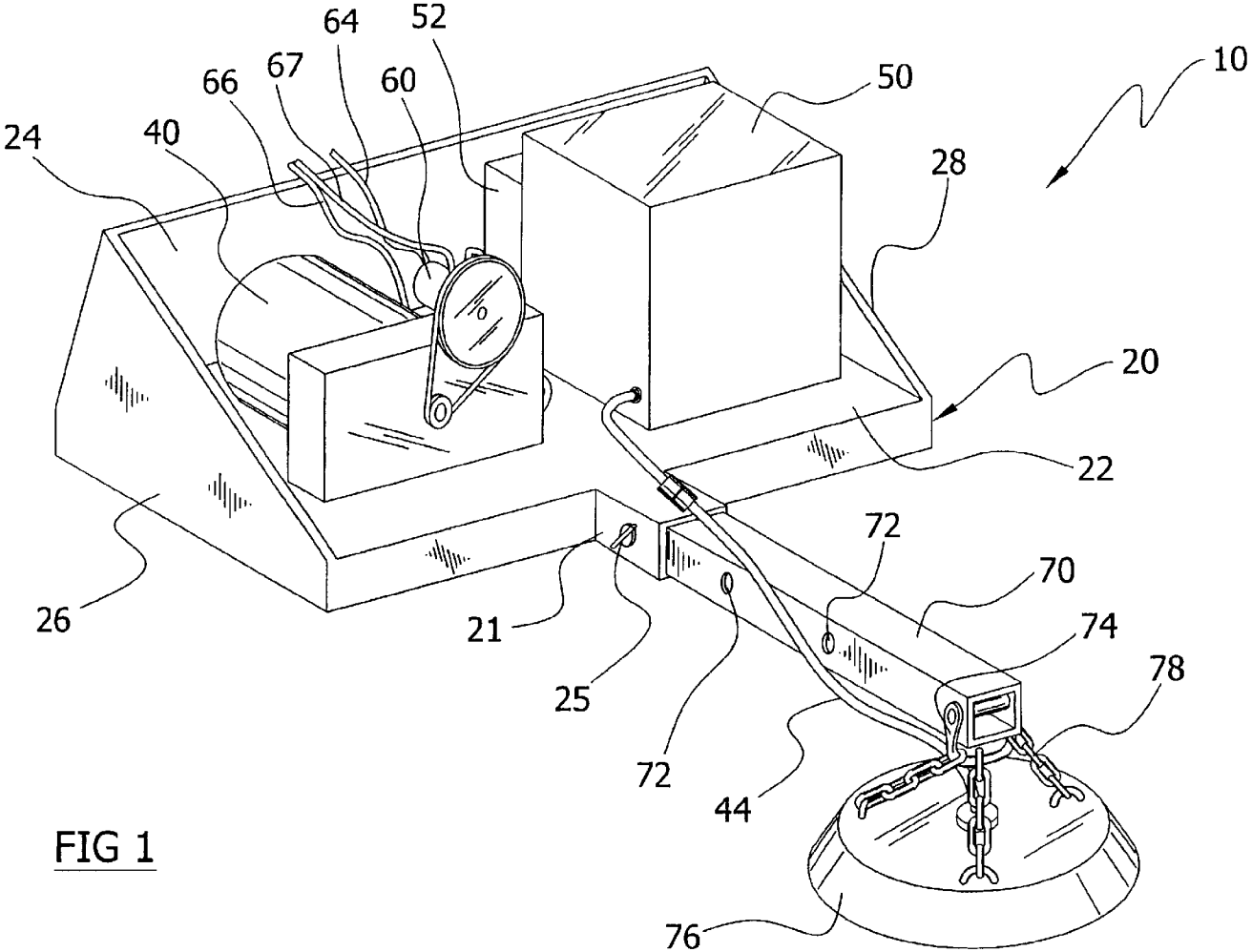
FIG. 1 is an upper perspective view of the present invention.

Turning now descriptively to the drawings, in which similar reference characters denote similar elements throughout the several views, FIGS. 1 through 4 illustrate a magnetic lifting system 10, which comprises a platform 20 attachable to a loader 14 of a tractor 12, an arm member 70 attached to the platform 20, and a magnet 76 attached to the arm member 70 by at least one chain. A generator 40 upon the platform 20 is mechanically connected to a hydraulic motor 60 that is fluidly connected to the hydraulic system of the tractor 12 to generate electricity. The generator 40 is electrically connected to a controller 50 which is electrically connected to a rheostat 52 for controlling current flow to the magnet 76. The rheostat 52 is electrically connected to the magnet 76 by a power cable 44. The arm member 70 is preferably slidably positioned within a receiver tube 21 for allowing distal adjustment of the position of the magnet 76 with respect to the platform 20.

FIG. 1 illustrates the platform 20 having a base 22, a first wall 26, a second wall 28 and a rear wall 24. The platform 20 may or may not include the first wall 26, the second wall 28 and/or the rear wall 24. The base 22 may have various shapes and sizes capable of supporting the generator 40 and controller 50. The first wall 26 and the second wall 28 may have various shapes and sizes other than illustrated in FIGS. 1 through 3 of the drawings. An attachment bracket 30 is attached to the rear wall 24 of the platform 20 for removably attaching to the loader 14 of a tractor 12. The attachment bracket 30 is comprised of any attachment structure capable of being attached to the loader 14 of a tractor 12. One suitable structure utilizes the well-known BOBCAT BOB-TACH mounting system which is commonly utilized upon BOBCAT brand skid steer tractors. Various other attachment brackets 30 may be utilized with the present invention which are commonly utilized for attaching attachments to a loader 14 of a tractor 12.

The arm member 70 may be adjustably or non-adjustably attached to the base 22 of the platform 20. A receiver tube 21 is preferably attached to the base 22 for slidably receiving the arm member 70 as shown in FIG. 1 of the drawings. A plurality of apertures 72 within the arm member 70 are aligned with a securing aperture within the extended portion of the receiver tube 21 thereby allowing for the insertion of a securing pin 25 within for preventing movement of the arm member 70. The arm member 70 may be adjusted to various lengths from the platform 20 depending upon the conditions of usage for the magnet 76. For example, if the magnet 76 will be handling relatively heavy material then the user will shorten the effective length of the arm member 70. If the magnet 76 will be handling relatively lighter material then the user can lengthen the effective length of the arm member 70. Various other configurations may be utilized to construct the arm member 70.

A clevis 74 or similar structure is attached to the distal portion of the arm member 70. One or more chains 78 extend from the clevis 74 and are attached to the magnet 76 thereby supporting the magnet 76 from the arm member 70 when the loader 14 of the tractor 12 is raised. Various other structures may be utilized to support the magnet 76 from the distal portion of the arm member 70.

Figure 2:
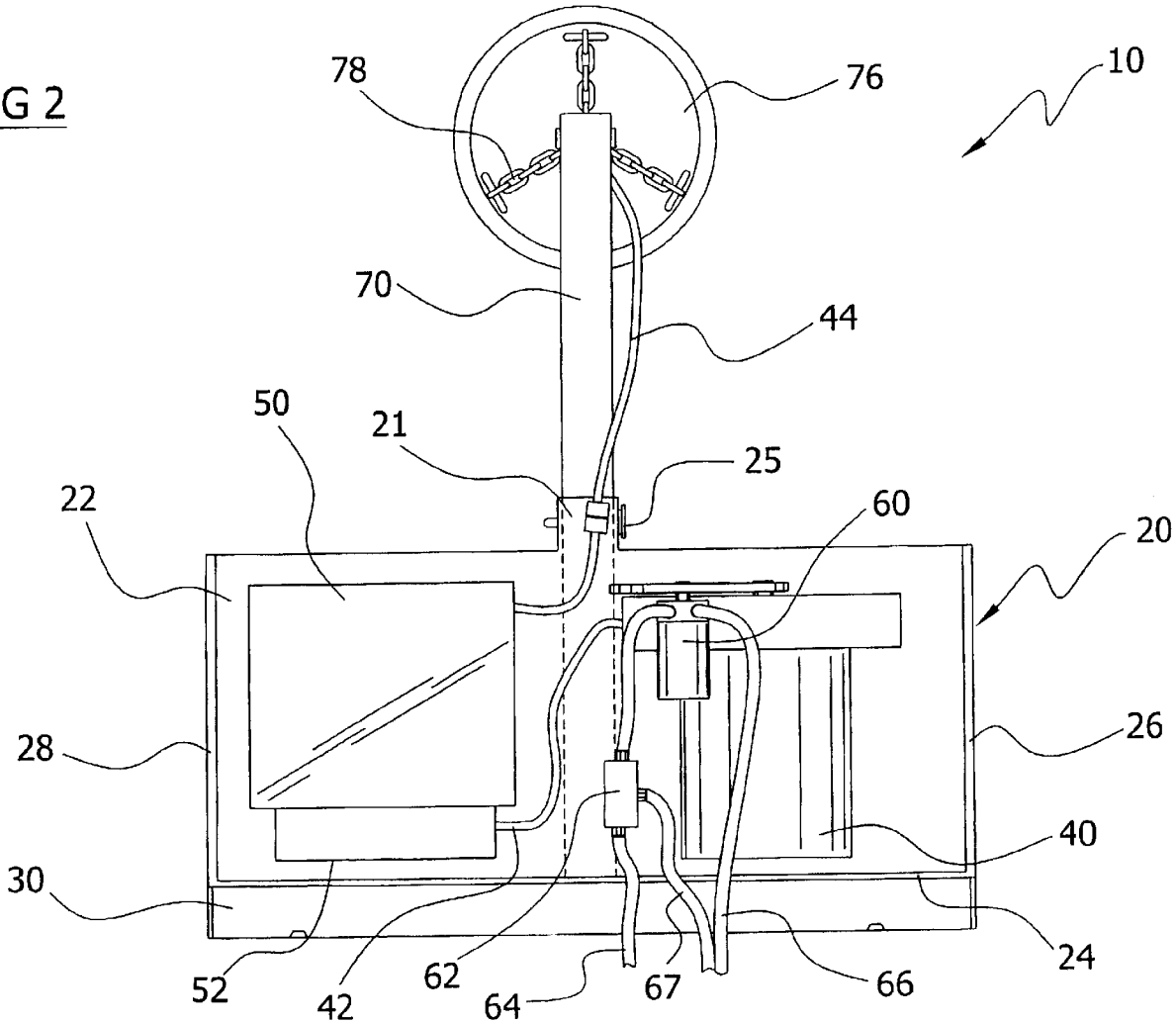
FIG. 2 is a top view of the present invention.

As shown in FIGS. 1 and 2 of the drawings, the generator 40, controller 50, rheostat 52 and hydraulic motor 60 are secured upon the platform 20. The hydraulic motor 60 is mechanically connected to the generator 40 by a chain, belt, geared transmission or similar linkage. The generator 40 may be comprised of various power sizes as may be required to provide adequate electrical power to the magnet 76.

The hydraulic motor 60 is fluidly connected to the pressurized hydraulic system of the tractor 12 thereby rotating the generator 40 for generating electrical power. An input hose 64 from the hydraulic system brings pressurized hydraulic fluid to the hydraulic motor 60. A flow control valve 62 may be positioned within the input hose 64 for allowing for the adjustment of the hydraulic fluid flow to the hydraulic motor 60 and for preventing damage to the hydraulic motor 60 during momentary hydraulic pressure loss. The flow control valve 62 may be adjusted manually or remotely controlled from the tractor 12 during operation which is well known in the art. A secondary hose 67 is connected to the flow control valve 62 for returning the diverted hydraulic fluid to the hydraulic system. A return hose 66 is fluidly connected to the hydraulic motor 60 and the hydraulic system for returning the hydraulic fluid passed through the hydraulic motor 60.

Figure 3:
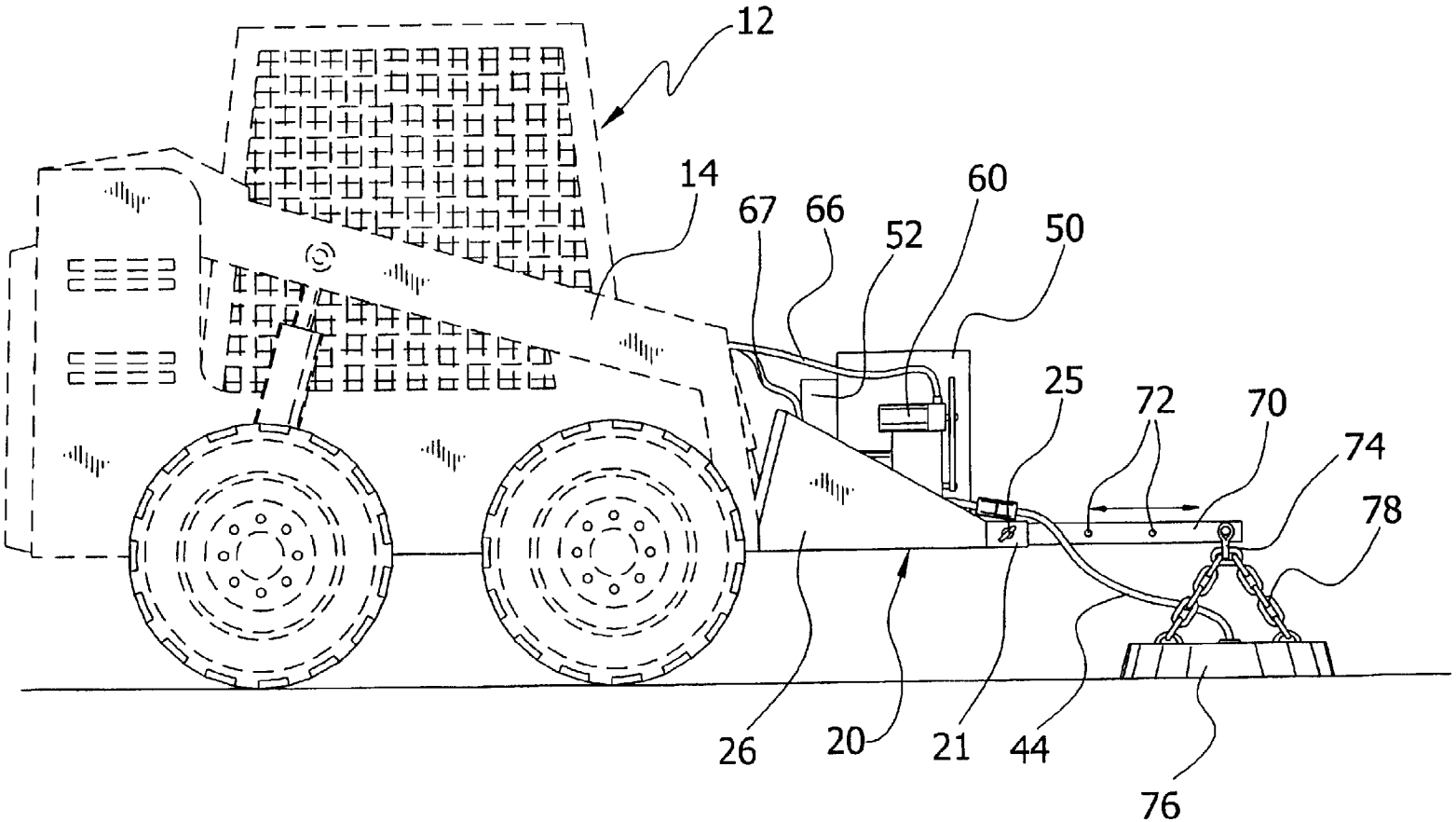
FIG. 3 is a side view of the present invention attached to a loader of a tractor.
Figure 4:
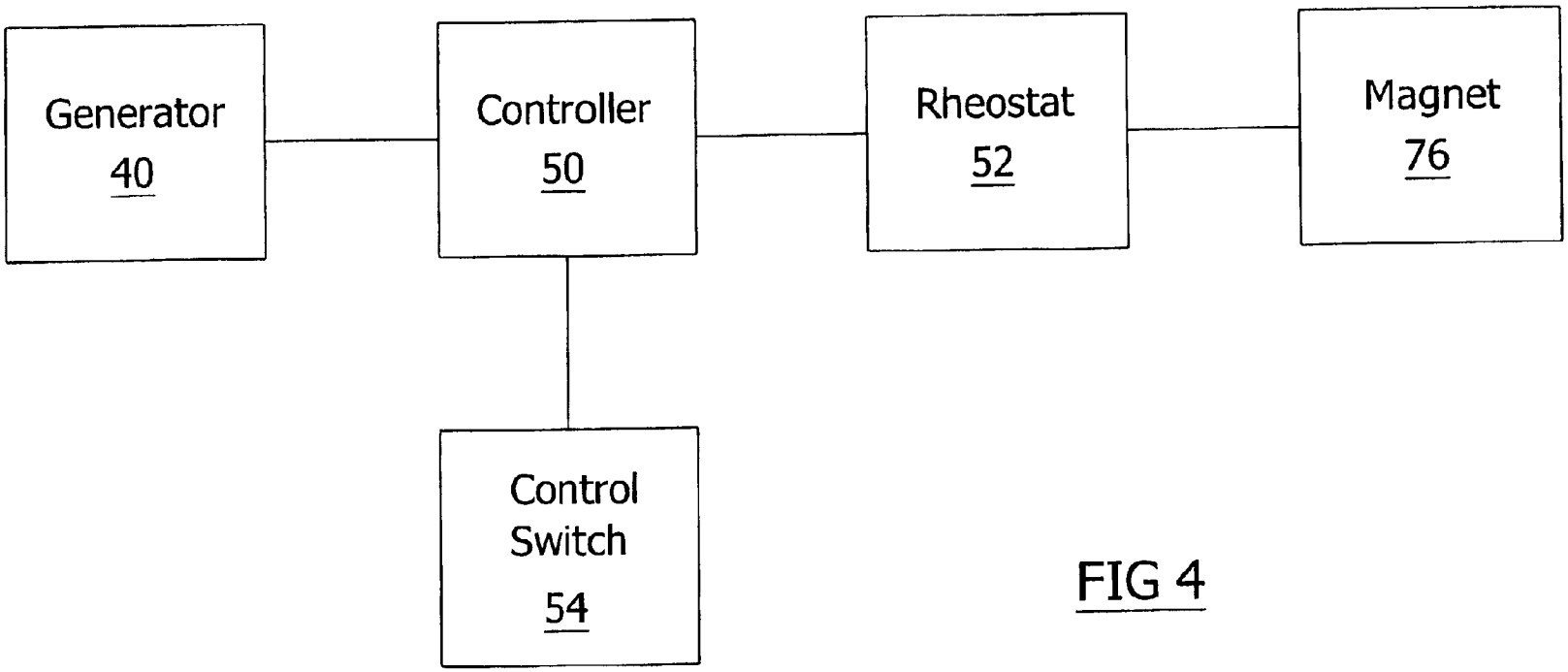
FIG. 4 is a block diagram of the electrical components of the present invention.

The controller 50 is electrically connected to the generator 40 by a connecting cable 42 for receiving the electrical power generated by the generator 40. The controller 50 is operated by a control switch 54 positioned within the cab of the tractor 12 thereby allowing the operator of the tractor 12 to control the flow of electrical power from the generator 40 to the magnet 76. A rheostat 52 is electrically positioned between the controller 50 and the magnet 76 for allowing adjustment of the current flow to the magnet 76 as illustrated in FIG. 4 of the drawings. A power cable 44 is electrically connected between the rheostat 52 and the magnet 76 as shown in FIGS. 1 through 3 of the drawings. The power cable 44 may be attached along the arm member 70 to prevent damage and interference of the operation of the present invention.

The magnet 76 is comprised of any structure that is controlled by the electrical current applied thereto. Magnets for usage within the magnetic lifting device industry are commonly utilized to controllable lift and release metal objects. The magnet 76 may have various sizes, shapes and electrical power requirements. The magnet 76 may be a permanent magnet or an electromagnet structure.

In use, the user operates the tractor 12 and the loader 14 in a normal manner. The user connects the loader 14 to the attachment bracket 30 of the platform 20 and then makes the appropriate hydraulic and electrical connections. The hydraulic system of the tractor 12 drives the hydraulic motor 60 which in turn drives the generator 40 thereby generating electrical power. When the user desires to activate the magnet 76 for collecting ferrous materials, the user closes the control switch 54 which closes the controller 50 thereby providing the electrical power from the generator 40 to the magnet 76 through the rheostat 52 as shown in FIG. 4 of the drawings. The user operates the tractor 12 to move the collected ferrous material to a desired location and then opens the control switch 54 thereby terminating the flow of electrical power from the generator 40 to the magnet 76. After the ferrous material is removed from the magnet 76, the user then repeats the above procedure.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Index of Elements for Magnetic Lifting System

| ENVIRONMENTAL ELEMENTS |
|---|
| 10. Magnetic Lifting System |
| 11. |
| 12. Tractor |
| 13. |
| 14. Loader |
| 15. |
| 16. |
| 17. |
| 18. |
| 19. |
| 20. Platform |
| 21. Receiver Tube |
| 22. Base |
| 23. |
| 24. Rear Wall |
| 25. Securing Pin |
| 26. First Wall |
| 27. |
| 28. Second Wall |
| 29. |
| 30. Attachment Bracket |
| 31. |
| 32. |
| 33. |
| 34. |
| 35. |
| 36. |
| 37. |
| 38. |
| 39. |
| 40. Generator |
| 41. |
| 42. Connecting Cable |
| 43. |
| 44. Power Cable |
| 45. |
| 46. |
| 47. |
| 48. |
| 49. |
| 50. Controller |
| 51. |
| 52. Rheostat |
| 53. |
| 54. Control Switch |
| 55. |
| 56. |
| 57. |

-continued

Index of Elements for Magnetic Lifting System

| ENVIRONMENTAL ELEMENTS |
|---|
| 58. |
| 59. |
| 60. Hydraulic Motor |
| 61. |
| 62. Flow Control Valve |
| 63. |
| 64. Input Hose |
| 65. |
| 66. Return Hose |
| 67. Secondary Hose |
| 68. |
| 69. |
| 70. Arm Member |
| 71. |
| 72. Apertures |
| 73. |
| 74. Clevis |
| 75. |
| 76. Magnet |
| 77. |
| 78. Chains |
| 79. |

I claim:

1. A magnetic lifting system for removably attaching to a loader of a tractor, comprising:

a platform;

an attachment bracket attached to said platform that is removably attachable to a loader of a tractor;

an arm member slidably positioned within a receiver tube attached to said platform, wherein an aperture extending through the arm member and the receiver tube receive a securing pin for securing the position of the arm member;

a generator attached to said platform;

a hydraulic motor fluidly connectable to a hydraulic system of a tractor and mechanically connected to said generator; and a magnet attached to said arm member by a connecting structure and electrically connected to said generator by a control circuit.

2. The magnetic lifting system of claim 1, wherein said control circuit is comprised of a controller electrically connected between said generator and said magnet.

3. The magnetic lifting system of claim 2, wherein a control switch is in communication with said controller for opening and closing said controller.

4. The magnetic lifting system of claim 2, including a rheostat positioned between said controller and said magnet.

5. The magnetic lifting system of claim 1, wherein said arm member is non-movably attached to said platform.

6. The magnetic lifting system of claim 1, wherein said connecting structure is comprised of at least one chain attached to a distal end of said arm member.

7. The magnetic lifting system of claim 6, wherein said connecting structure is comprised of at least one chain attached to a clevis that is attached to a distal end of said arm member.

8. The magnetic lifting system of claim 1, wherein said magnet is an electromagnet.

9. The magnetic lifting system of claim 1, wherein said magnet is a permanent magnet.

10. A magnetic lifting system for removably attaching to a loader of a tractor, comprising:

a platform having a base, a rear wall, a first wall and a second wall;

an attachment bracket attached to said platform that is removably attachable to a loader of a tractor;

an arm member slidably positioned within a receiver tube attached to said platform, wherein an aperture extending through the arm member and the receiver tube receive a securing pin for securing the position of die arm member;

a generator attached to said platform;

a hydraulic motor fluidly connectable to a hydraulic system of a tractor and mechanically connected to said generator; and a magnet attached to said arm member by a connecting structure and electrically connected to said generator by a control circuit.

11. The magnetic lifting system of claim 10, wherein said control circuit is comprised of a controller electrically connected between said generator and said magnet.

12. The magnetic lifting system of claim 11, wherein a control switch is in communication with said controller for opening and closing said controller.

13. The magnetic lifting system of claim 11, including a rheostat positioned between said controller and said magnet.

14. The magnetic lifting system of claim 10, wherein said arm member is non-movably attached to said platform.

15. The magnetic lifting system of claim 10, wherein said connecting structure is comprised of at least one chain attached to a distal end of said arm member.

16. The magnetic lifting system of claim 15, wherein said connecting structure is comprised of at least one chain attached to a clevis that is attached to a distal end of said arm member.

17. The magnetic lifting system of claim 10, wherein said magnet is an electromagnet.

18. The magnetic lifting system of claim 10, wherein said magnet is a permanent magnet.

* * * * *